United States Patent [19]

Fischer et al.

[11] Patent Number: 4,680,452

[45] Date of Patent: Jul. 14, 1987

[54] ELECTRIC HOTPLATE WITH A THERMOSTAT

[75] Inventors: Karl Fischer; Felix Schreder, both of Oberderdingen; Robert Kicherer, Knittlingen, all of Fed. Rep. of Germany

[73] Assignee: E.G.O. Elektro-Gerate Blanc u. Fischer, Fed. Rep. of Germany

[21] Appl. No.: 861,083

[22] Filed: May 8, 1986

Related U.S. Application Data

[62] Division of Ser. No. 511,104, Jul. 6, 1983, Pat. No. 4,605,841.

[30] Foreign Application Priority Data

| | | | |
|---|---|---|---|
| Jul. 7, 1982 | [DE] | Fed. Rep. of Germany | 8219461 |
| Jul. 14, 1982 | [DE] | Fed. Rep. of Germany | 3226264 |
| Sep. 28, 1982 | [DE] | Fed. Rep. of Germany | 8227145 |
| Jan. 20, 1983 | [DE] | Fed. Rep. of Germany | 3301689 |

[51] Int. Cl.[4] ..... H05B 3/68

[52] U.S. Cl. ..... 219/449; 219/450; 219/443

[58] Field of Search ..... 219/449, 448, 450, 443, 219/458, 459, 460, 516; 361/383, 386

[56] References Cited

U.S. PATENT DOCUMENTS 4,135,081 1/1979 Fischer ..... 219/449

FOREIGN PATENT DOCUMENTS 1442112 5/1966 France ..... 219/443

98908 9/1961 Norway ..... 219/449

*Primary Examiner*—E. A. Goldberg

*Assistant Examiner*—Teresa J. Walberg

*Attorney, Agent, or Firm*—Steele, Gould & Fried

[57] ABSTRACT

An electric hotplate (2) with a cast iron hotplate body (1) has in its unheated central area (14) a thermostat (19) which, by projections (51) on a cover plate (17), is forced into clearly defined contact with the lower surface (50) of the hotplate body (1) in the vicinity of the unheated central area (14). Casing (23) of thermostat (19) has three projections (8), which are supported on surface (50). The unheated central area (14) does not have to be covered by any cover separate from cover plate (17*a*). Casing (23) has a recess open on one side and which is not closed by a cover.

28 Claims, 16 Drawing Figures

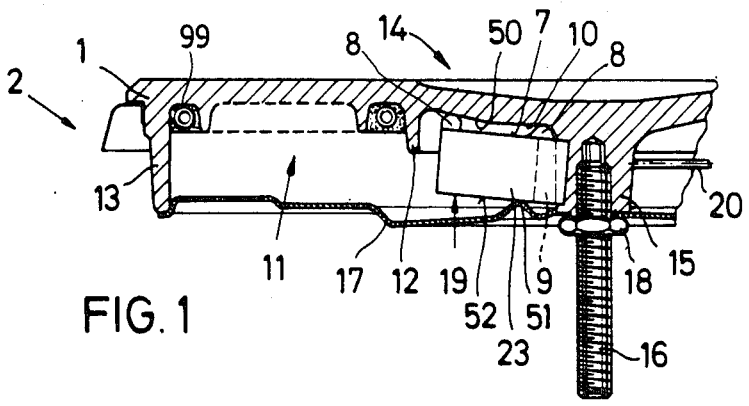
FIG. 1
FIG. 2
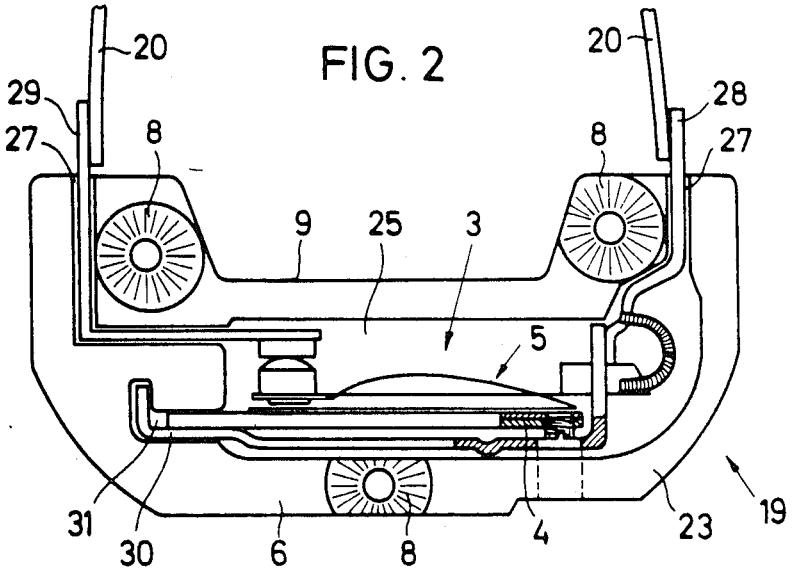

ELECTRIC HOTPLATE WITH A THERMOSTAT

CROSS REFERENCE TO RELATED APPLICATION

This is a division of application Ser. No. 511,104, filed July 6, 1983, now U.S. Pat. No. 4,605,841.

BACKGROUND OF THE INVENTION

1. Field of the Invention

The invention relates to electric hotplates with a thermostat.

2. Prior Art

Such a thermostat is known from German Pat. No. 1,123,059. Millions of such thermostats have been incorporated into hotplates, they function extremely reliably and are particularly suitable for functioning as thermostats with a high switching hysteresis relatively weakly coupled to the temperature of the heating system. The thermostat comprises a crescent-shaped insulating casing, whose recess contains a snap-action switch and a bimetallic strip parallel thereto, while being fixed by passing through slots of openings. The casing is closed by a cover and the thermostat is arranged in the unheated central area of the electric hotplate and partially surrounds the cast central pin. The cover points downwards and the snap-action switch and bimetallic strip are laterally secured.

SUMMARY OF THE INVENTION

The object of the present invention is to provide a thermostat, which can be manufactured even less expensively and which has smaller dimensions, while its coupling characteristics to the hotplate are improved. According to the invention, this object is achieved in that recess is open to one side in the built-in state.

As a result of the box-like casing, which is open on one side, the bimetallic strip is coupled better to the temperature to be monitored by it both by convection and by radiation. This is helped if the thermostat designed for placing in the unheated central area of the electric hotplate has its open side pointing horizontally, i.e. normally, towards the heating system. However, its coupling characteristics can also be deliberately modified by some other arrangement. It is also possible to modify the coupling characteristics by the snap-action switch and bimetallic strip being located in a horizontal plane in the built-in state, the coupling characteristics changing as a function of whether the bimetallic strip faces or is remote from the hotplate body.

The very small box-like casing not only has a very uncomplicated construction and can consequently very easily be made from ceramic material (steatite being normally used), but also has a very small weight, there is no risk of moisture being deposited on the casing through condensation and which could lead to leakage currents.

Preferably, the end and side walls of the casing surrounding the recess opening project by 1 to 3 mm over the snap-action switch and bimetallic strip. As a result of this, and the other features already described, it is possible to construct the thermostat without a cover.

According to another feature of the invention, the support carrying the snap-action switch and the bimetallic strip can be secured by an automatic locking system acting with a limited longitudinal movement.

According to one embodiment, in which the thermostat casing is supported on the cover plate and the thermostat is pressed with clearly defined contacts against one surface of the hotplate body in the unheated central area, it is possible to do away with the cover hitherto used for surrounding the thermostat, which contributes to the reduction in manufacturing and assembly costs. The specific heat of the overall arrangement also decreases and there is also no need for the otherwise necessary insulating bushing for the connecting leads of the thermostat through the cover. Preferably, projections are provided on the casing side containing the recess opening and they are pressed into contact with the hotplate body surface. Preferably, three projections are shaped onto the edge surrounding the recess and these in particular have a rounded, or optionally a conical configuration. Their function is on the one hand to ensure adequate spacing between the functional part of the thermostat arranged in the recess and the hotplate body, and on the other hand to ensure a clearly defined engagement, while still permitting a certain ventilation of the thermostat from below.

Advantageously, a perforated, cup-shaped covering part can be provided for the unheated central area. As a result of the tight, latticed structure of the cup, which is grounded through the grounding of the hotplate body, the cup provides complete electrical protection despite an effective ventilation of the central area, it so that a temperature sensor can be used, whose switch casing is at least open on one side. Advantageously, the temperature sensor of the thermostat is arranged in the switch casing. The overall level of temperature monitoring of the hotplate can be lowered somewhat, so that it is possible to use a simpler, robust switch, which is integrated with a temperature sensor. The temperature limiting action is still completely satisfactory, although at a first glance it would not appear appropriate to lower the temperature level to be monitored, before sensing it with a thermostat.

In addition, a hotplate is proposed, in which the thermostat casing is open on its side remote from the hotplate and the switch parts inserted in the recesses are protected against falling out by at least one fixing part, which at least partly covers the slots and can be placed in recesses of the switch casing, said fixing part directly engaging with the cover plate, or the hotplate body. As a result, it is possible to do away with the cap which normally surrounds the thermostat, which naturally leads to cost savings. Cost savings also result from the omission of the thermostat casing cover, particularly when assembling the switch from individual parts. The fixing part has a lower weight than the hitherto known cover, which leads to cost savings from the material side and to a reduction of the specific heat of the casing. Due to the fact that there is no need to use a covering cap, it is also possible to do without an insulating bushing for the lead-in wires for the thermostat. Features of the preferred further developments of the invention can be gathered from the following description drawings and claims. Individual features can be realised either alone or in random combinations in connection with any embodiment of the invention.

BRIEF DESCRIPTION OF THE DRAWINGS

Non-limiting embodiments of the invention are shown in the drawings wherein

FIG. 1 is a diagrammatic partial section through a hotplate with a thermostat.

FIG. 2 is a larger-scale, plan view of a thermostat, viewed from above in FIG. 1.

Figure 3:
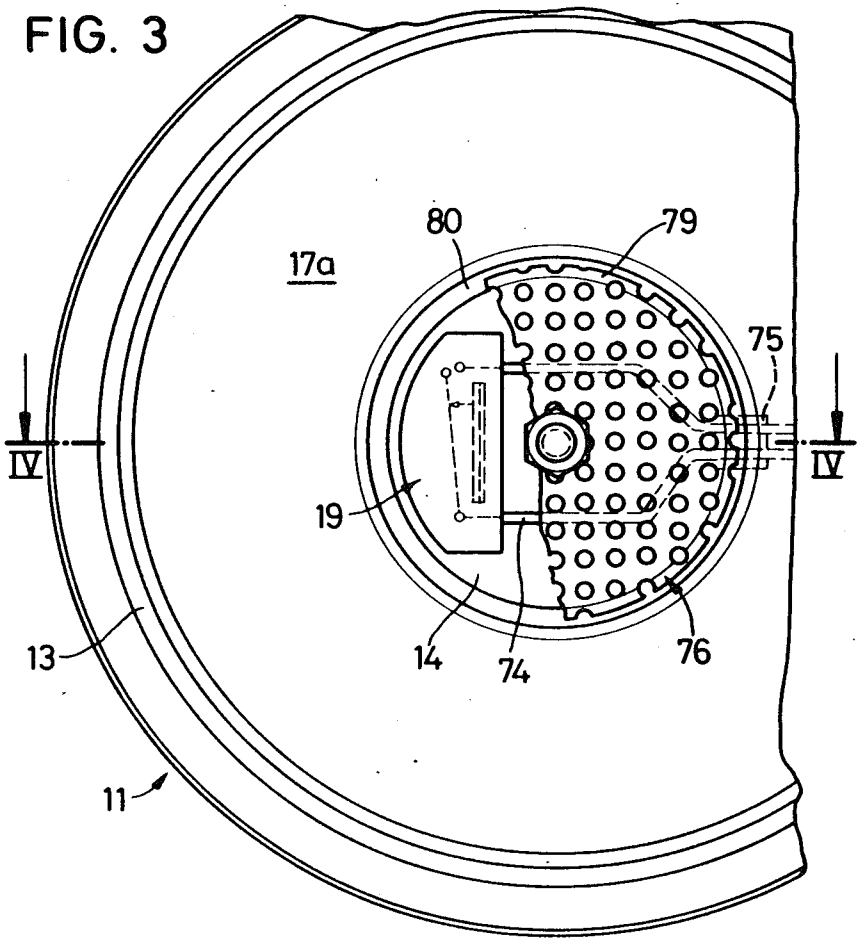
FIG. 3 is a partly broken away view from below of a hotplate with a covering part.
Figure 4:
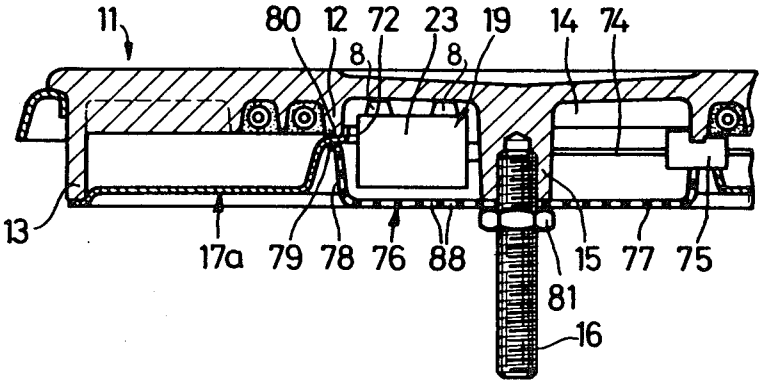
FIG. 4 is a section along line IV—IV of FIG. 3.

The electric hotplate 2 shown in FIG. 1 has a hotplate body 1 made from cast material, preferably cast iron, with a ring-shaped heating area 11, which is bounded to the outside and inside by downwardly projecting ring ribs 12, 13. Electric heating resistors 99 are located in the heating ring area and are embedded in insulating material in slots of the hotplate body. Within the inner ring rib 12 there is an unheated central zone 14, which is not directly heated in whose center there is a lug 15 in the form of a downwardly projecting cast pin, into whose tap hole is screwed a clamping bolt 16.

The bottom of the electric hotplate is enclosed by a profiled cover plate 17 which, in the embodiment of FIG. 1, rests on the lower edge of the annular outer ring rib 13, covers the entire bottom surface of the hotplate and is pressed upwards by bolt 16 and a nut 18 screwed thereon.

A thermostat 19 is arranged in the unheated central zone 14. It is connected by means of leadin wires 20 and serves to switch off the heating system or parts thereof, if the hotplate assumes a temperature above its set thermostat temperature. It is desirable for the thermostat to respond with a certain time lag, because as a result, it can be set in such a way that it permanently switches off at an elevated initial cooking or boiling power after it has responded, in order to provide adequate power for final cooking or continued boiling.

DETAILED DESCRIPTION OF THE PREFERRED EMBODIMENTS

Thermostat 19 is shown on a larger scale in FIG. 2. Its construction and function corresponds to German Pat. No. 1,123,059, to which reference is made. The functional parts 3 of the thermostat are arranged in a recess 25 of a casing 23, made from insulating material, such as steatite, the function of parts 3 are fixed by insertion in slots formed in casing 23. The parts include a bimetallic strip 4, which is fitted to a support 30 inserted in a slot 31, and moves the spring reed of a catch spring of a snap-action switch 5. On one end of the catch spring is provided a contact, which cooperates with a fixed opposite contact and a connecting strip 29, which like connecting strip 28 are inserted in slots 27 of the casing and consequently secured for supplying power to the catch spring. In plan view, the casing is largely crescent-shaped, or could also be described as rectangular with a recess on one longitudinal side and shoulders on the facing longitudinal side.

As can be seen in FIGS. 1 and 2, there are three projections 8 on top 7 on the casing edge 6 surrounding recess 25 and towards which recess 25 has its opening. These projections are constructed in one piece with casing 23 and have a conical configuration with a rounded tip.

It can be seen in FIG. 1 that thermostat 19 is arranged in the central area in such a way that the central lug 15 is positioned in recess 9 which is formed on one longitudinal side of the casing, the side of the lug has a flattened portion, which meets a flattened portion 10 formed in the lower surface 50 of central area 14.

Cover plate 17 has preferably only one projection 51, which is constructed as an inwardly directed reinforcing corrugation of the cover plate and presses onto the flat bottom 52 of casing 23. As a result, projections 8 are firmly pressed against surface 50 of the hotplate body in the vicinity of the central area. Although the opening of recess 25 is open to the top, the recess is nevertheless covered by the bottom surface 50 of the hotplate body and is consequently protected against intrusive contact.

On tightening bolt 16 or nut 18, the thermostat is consequently pressed into contact with the hotplate body. The maintenance of this pressure is assisted by the elastic construction of the cover plate, but could also be assisted by a corresponding spring element and/or the shaping of the end cover or projection 51. For example, it would be conceivable to make the area around the projection resilient by providing slots in the cover plate.

In FIG. 3, the heating ring area 11 is covered towards the bottom by a cover plate 17*a*, which rests on rims 12 and 13 and which is centered by a bent-round portion 72 in the interior of inner rim 12.

Thermostat 19 is connected into one of the hotplate circuits by two connecting strips 74, forming electric leads. Leads 74 are led out of the central area by means of an insulating bushing 75 facing the thermostat 19. The central area is covered by a covering part 76, which is in the form of a relatively flat cup with a substantially planar bottom 77, a substantially cylindrical surface 78 and an outwardly projecting support flange 79 at the end of the cylindrical surface 78. This support flange 79 rests on a shoulder 80 of cover plate 17*a* and presses the latter against the bottom of rim 12. The cup-shaped covering part 76 is made from perforated steel metal material with a relatively large thickness of preferably over 0.8 mm, and in the present embodiment it is 1 mm thick. In the present embodiment, the sheet metal material has circular holes 80, arranged in a random manner and whose diameter is only a few millimeters. The perforated area is preferably between one (1) and two thirds, ($\frac{2}{3}$) of the total surface area, and in a particularly preferred embodiment is one half ($\frac{1}{2}$) of the total surface area. As a result of manufacturing the cup from sheet metal material perforated prior to cup deformation, the holes are arranged over the entire cup surface, nevertheless in the vicinity of the outer support flange 79, the material forms such a relatively continuous surface that the cup uniformly presents cover plate 17*a* against rim 12.

Covering part 76 is secured by means of a nut 81 screwed onto the clamping bolt 16, so that the cover plate 17*a* is also fixed.

Thermostat 23 is open at one side, i.e. its bimetallic strip and current-carrying switch parts are not covered by a separate insulating cover. It is virtually impossible in normal operation that anything could come into contact with these current-carrying parts, without simultaneously coming into contact with the grounding system, which is provided by the latticed or perforated covering part.

Figure 5:
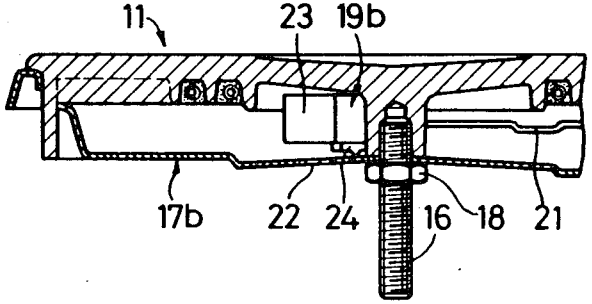
FIG. 5 is a partial section through a hotplate.

The hotplate in FIG. 5 corresponds to that of FIG. 1, apart from the differences described hereinafter.

In the vicinity of thermostat 19, cover plate 17*b* is provided with a plurality of vents. Between the casing 23 of thermostat 19 and cover plate 17*b*, there are two fixing parts 24.

Figure 6:
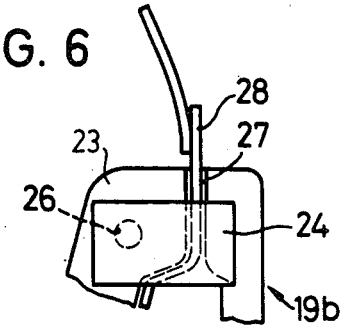
FIG. 6 is a detail of a thermostat.

FIG. 6 shows a larger-scale detail of casing 23 of a thermostat 19*b*. Its casing 23 has three holes 26 which, in the case of conventional mounting arrangements for thermostats, serve to fix a cover from above onto the casing. There is a slot 27, through which passes a connecting element 28 of thermostat 19*b* and which is enclosed by a fixing part 24. On the bottom of fixing part 24, there is a cylindrical pin, which is inserted in the dottedline hole 26. Thus, it covers the connecting element 28 and prevents any unintentional movement of the complete switch mechanism out of the casing and supports the thermostat on the cover plate or the hotplate body. For fixing the left-hand connecting element 29 (FIG. 2) and the switch support 30, in this case a common fixing element is used, which engages with a cylindrical shoulder in hole 26 and with at least one further shoulder in the left-hand slot 27 or in recess 31 for switch support 30.

Figure 7:
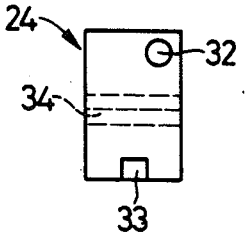
FIGS. 7 to 9 are partial perspective views of fixing parts.

FIG. 7 is a view from below of a fixing element 24, which has a circular cylindrical shoulder 32 and a parallelepipedic shoulder 33. It is placed on casing 23 of thermostat 19 in such a way that shoulder 32 engages in hole 26 and shoulder 33 in slot 27.

Figure 8:
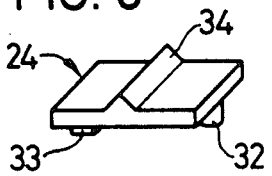
Figure 9:
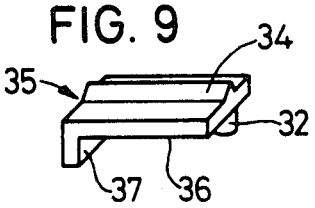

FIG. 8 shows the fixing element 24 according to FIG. 6. On the side of the fixing element opposite to shoulders 32, 33 is provided a rib 34, which provides a linear engagement of cover plate 17*b*.

Fixing element 35 according to FIG. 6 has on its bottom surface 36, an elongated shoulder 37, which is as long as the fixing element is wide, as well as a cylindrical shoulder 32 and a rib 34.

Figure 10:
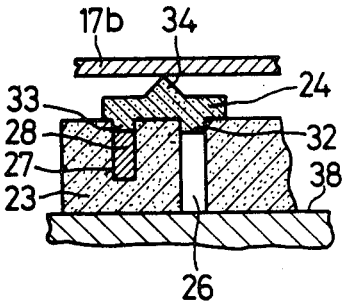
FIGS. 10 and 11 are partial sections through the thermostat casing and cover plate.

In FIG. 10, casing 23 of thermostat 19 engages flush on the bottom surface 38 of the unheated central area 14 of the hotplate. The connecting element 28 is inserted in a slot 27, which is open at one side. One shoulder 32 of fixing element 24 engages in hole 26, while its second shoulder 33 engages in slot 27 above connecting element 28 and is consequently secured against rotation. Cover plate 17*b* is arranged above fixing element 24 and is screwed onto central lug 15 in the manner stated hereinbefore. It engages on rib 34 of fixing element 24. As a result of this arrangement, in the case of a turned-round built-in state, all the switch or thermostat elements are protected against falling out, so that they do not have to be cemented in.

Figure 11:
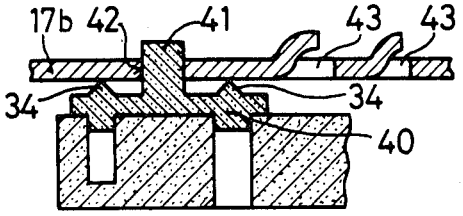

FIG. 11 shows that on its side remote from the hotplate, a further fixing element 40 has, in addition to two ribs 34, a higher shoulder 41, which engages in an opening 42 of cover plate 17. As a result of shoulder 41, it can easily be established from the outside, i.e. from above in FIG. 8, whether fixing element 40 is correctly positioned.

To the right and alongside opening 42 for shoulder 41, cover plate 17*b* has two slots 43, which have been formed by stamping out and bending away.

FIGS. 12 to 15 show a thermostat 111. It has a casing 113 made from ceramic insulating material, e.g. steatite, having the shape of an elongated, rectangularly defined box, whose one long side is open. Correspondingly, the casing has two narrow end walls 115, 117, two side walls 119, 121 and a bottom 122, which bound a recess 123, while the only remaining side is the open side 124.

In recess 123 is placed a rigid sheet metal material support 125, which extends along side wall 121 and is supported thereon with a stamped part 141. A short, strong bimetallic strip 127 is fixed parallel thereto by spot weld 128, by means of which is also fixed a movable abutment 129 constructed as a flexible sheet metal strip with a one-sided bend. By turning an adjustment screw 143, which is accessible through an opening 144 in side wall 121, it is possible to adjust the bend of the particular abutment with respect to bimetallic strip 127 and consequently the basic setting of a snap-action switch 131. The latter has a catch spring arm 133, reinforced by laterally edged parts and it center is stamped out in reed-like manner and forms a catch spring 130, which is supported in the abutment 129 under bending bias. At its free end, the catch spring arm carries a contact 134 while the other end is supported in a knife-edge bearing 135, which is located on an upward bend 137 of support 125. In order not to load the knife-edge bearing 135 by the currents to be switched, a connecting stranded wire 145 is welded to the catch spring arm 133 and to support 125.

To permit the free operation of the bimetallic strip, support 125 has a number of steps and at its one end 139 has two outer, foot-like projections, which are placed in two cavities 147, whereof one is open towards recess 123 and towards the open side 124, while the other is arranged in undercut manner by an intermediate end wall portion 149 projecting towards the recess, so that when end 139 located in the bottom-facing cavity 147, end 139 prevents a movement of the support in the direction of open side 124. An opening 151 in the bottom area is provided only for manufacturing reasons, in order to permit the manufacture of the undercut cavity 147 in a single split mold without cores and slides.

The other end 153 of the support forms an electrical connecting lug for a connecting lead 155, which is welded to said lug.

End 153 forms a narrow extension in the vicinity of bottom 122 and projects through an opening 157, which passes through the corner between end wall 117 and bottom 122 and consequently forms an opening accessible from the end wall and the bottom, whose height (at right angles to the plane of support 125) is significantly greater than the thickness of the support (approximately 3 to 4 times).

The end of support 125 within recess 123 forms a stop face 159 which, in the fitted state, faces a protection surface 161 (cf FIG. 14), which forms a step in end wall 117. From the open side 124, the protection surface can extend up to opening 157 and namely up to a height roughly corresponding to the center of opening 157.

An opposite contact 163, placed on an opposite contact support 164, faces contact 134 of snap-action switch 131. Support 164 is inserted in a slot 163, which has the flat V-shaped configuration shown in FIG. 13 and consequently relatively reliably fixes in clearance-free manner, the correspondingly dimensioned opposite contact support 164 during its insertion. The final securing action is provided by welding a connecting lead 166 to the portion of the opposite contact support 164 projecting outwards over bottom 122.

During manufacture, the complete functional unit consisting of support 125, bimetallic strip 127 and snap-action switch 131 are completely preassembled. The short, strong bimetallic strip 127, which tapers somewhat to a free end, is welded to the support, together with the abutment 129, the catch spring arm 133 and catch spring 130 are hung in and the stranded wire 145 is welded. Opposite contact support 164 is inserted in slot 165 and then the aforementioned preassembled unit is introduced into recess 123. Initially, end 153 is slopingly placed through opening 157 in such a way that the stop face 159 of support 125 (cf FIG. 12 or 14) is above the protection surface 161. Thus, support 125 can be moved so far to the left that end 139 can be swung in inwardly the direction of the curved arrow 167 in FIG. 13 and end 139 can still be freely moved from the projecting end wall portion 149. When support 125 has been introduced into its position engaging on bottom 122, it is only necessary to form support 125 to the right and, as a result of its own bias, catch spring arm 133 presses support 125 downwards in FIGS. 12 and 14, so that stop face 159 faces protection surface 161 and now no longer permits a leftward displacement of support 125, so that the snap-action switch support is secured in the position shown in FIGS. 12 and 14. The final securing action is brought about in that on welding connecting lead 155, the latter is forced into the part of opening 157 remaining above end 153, for which purpose the lead can be slightly bent.

Figure 13:
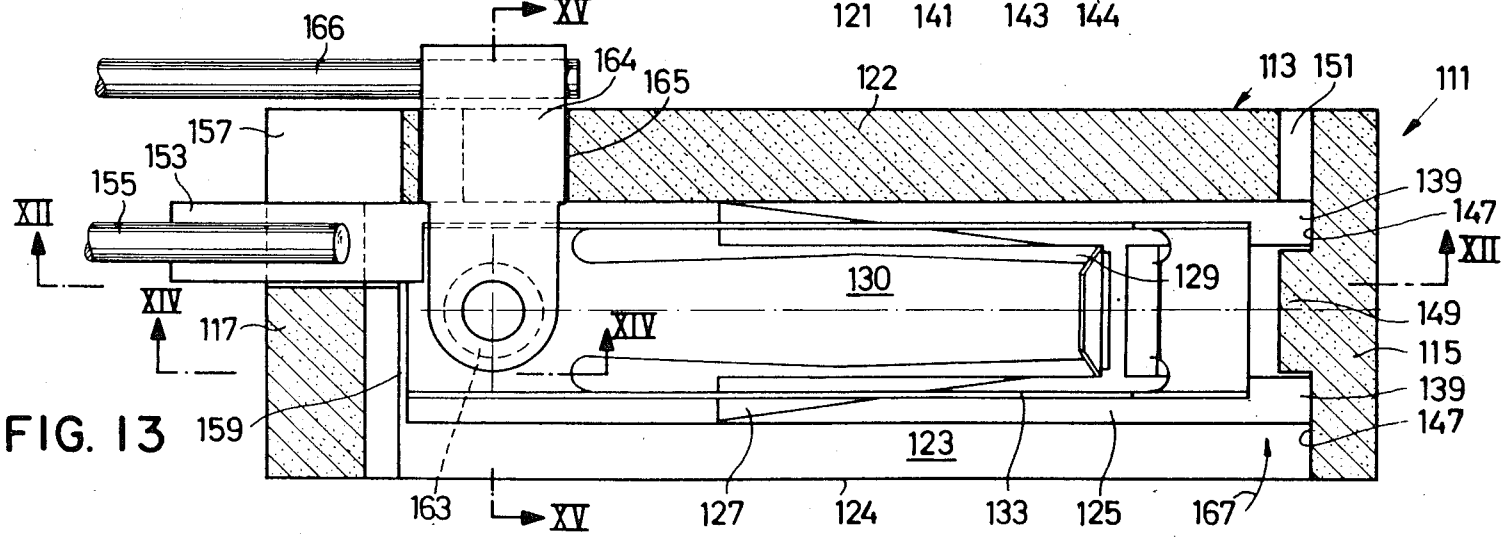
FIG. 13 is a section along the bent section line XIII—XIII in FIG. 12.
Figure 14:
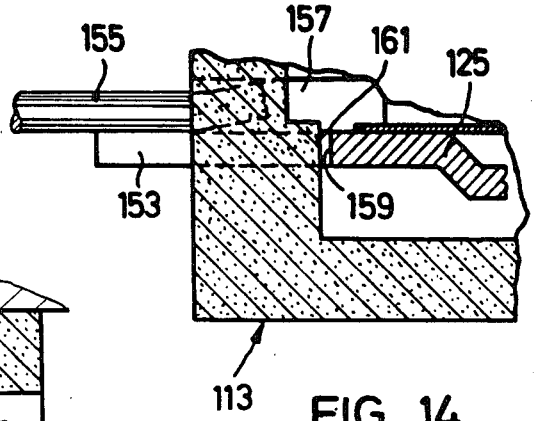
FIG. 14 is a detailed section along line XIV—XIV in FIG. 13.
Figure 15:
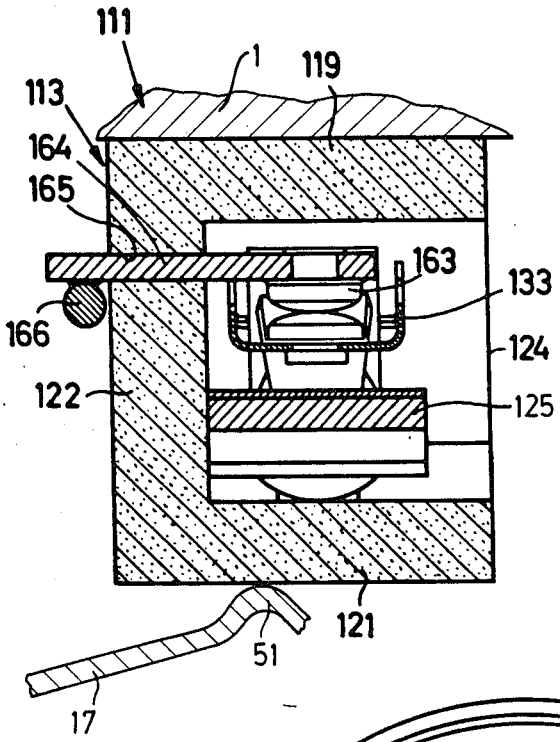
FIG. 15 is a cross-section along line XV—XV in FIG. 13.

FIGS. 13 and 15 show that fixing has taken place in such a way that the current-carrying or live unit formed by support 125, bimetallic strip 127 and snap-action switch 131 is a considerable distance from open side 124, i.e. the end and side walls 115 to 121 project between 1 and 3 mm beyond said parts. In view of the relatively limited width of the recess (less than 10 mm), this provides an adequate protection against contact, so that there is no need for a cover projecting over recess 123. This improves the thermal coupling of the thermostat and further reduces its already limited overall weight, which is advantageous from the switching and leakage current behaviour standpoint.

Figure 12:
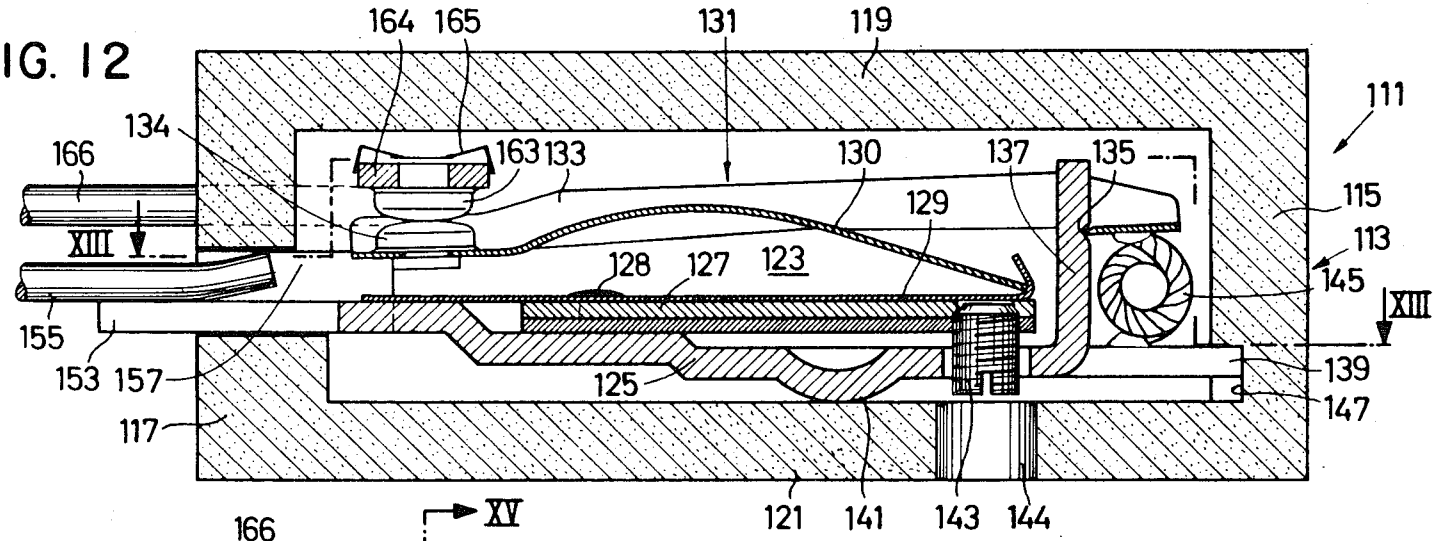
FIG. 12 is a longitudinal sectional through a thermostat along line XII—XII in FIG. 13.

The snap-action switch adjusted by raising the movable abutment 129 with respect to bimetallic strip 127 is operated if, as a result of heating, bimetallic strip 127 has bent so far upwards in FIG. 12 that the snapping point of the switch is reached. Contacts 134, 163, which are shown closed, are then opened.

Figure 16:
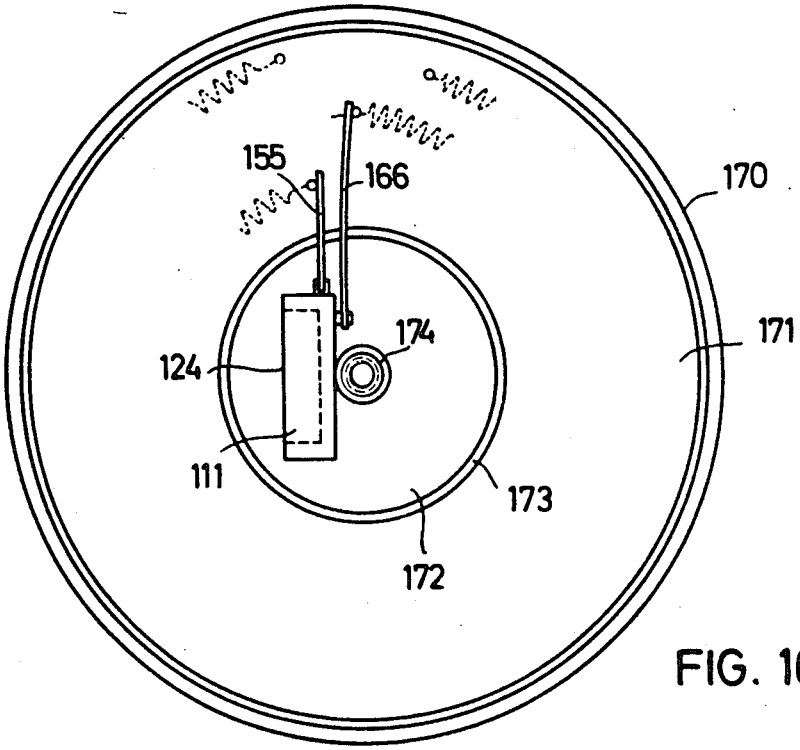
FIG. 16 is a view from below of a hotplate equipped with a thermostat.

FIG. 16 shows the thermostat 111 in its arrangement on a hotplate 170. The latter is a cast plate with a heated ring area 171, where thermostat 111 is arranged in the unheated central area 172 surrounded by a rim 173. It is placed on one side of a cast-on fixing connection 174 with its open side 124 towards rim 173 and consequently pointing towards the heating system. The connecting leads 155, 166 pass directly to corresponding terminal pins, which project from the ceramic embedding material in the heated ring area and lead to one or more heating resistors in the heated ring area.

In the position represented in FIG. 16, the interior of the thermostat is freely accessible to the heat coming from the hotplate, both by radiation and by conduction and convection. By changing the position, in such a way that e.g. the open side 124 faces fixing connection 174, these couplings can be modified. Normally, the thermostat is fitted between the underside of the central zone of the hot plate body 1 and projections 51 of a cover 19 as shown in FIG. 1, in such a position that side 121 engages on the hotplate body, so that the bimetallic strip is nearer thereto. The coupling characteristics are also changed by turning the thermostat around to effect (engagement of side 119).

The thermostat is particularly easily manufactured. Its casing comprises a single ceramic piece, which can be produced in a single split mold only two parts need be fitted into the casing, which can both be fixed by insertion, without any need of cementing or the like. These parts one the opposite contact support and the preassembled unit formed by the support, bimetallic strip and snap-action switch. The single adjustment screw is readily accessible. The individual parts are fixed by the welding of the connecting lead, which is necessary in any case. The thermostat can still be used in many different ways and its coupling (fast or slow acting) can be adapted to different requirements by merely turning round at the time of fitting. It has been found that there is no need with this thermostat to cover the central area 172 of the hotplate with a separate cover, as has been hitherto necessary, while there is no increased risks of leakage currents.

It is also advantageous that the two connections 153, 164 are located in the vicinity of a narrow side of the casing, so that the connecting leads leading therefrom are short and can pass in juxtaposed manner through a recess in the rim 173.

We claim:

1. An electric hotplate, comprising:

a hotplate body including a central zone without direct heating means applied thereto, and a heated outer zone provided with heating resistors;

electric circuitry for connecting the heating resistors to a source of electrical energy including a thermostat positioned on a bottom side of the hotplate body and having a casing made from an insulating material;

the casing of the thermostat having a recess with a snap-action switch therein and a bimetallic strip acting on the switch disposed in the recess, a snap-action contact of the switch and the bimetallic strip being mounted on a support inserted from an open upper side of the casing into slots of the recess, an end portion of said support projecting through one of said slots and forming a connecting lug and securing said support in said casing;

an upper side of the casing being spaced at a distance from the bottom side of the hotplate body with the casing being mounted on the hotplate body, and the recess of the casing being open only on the upper side of the casing;

at least one projection projecting upwards at the upper side of the casing in the vicinity of the recess, the projection abutting against the bottom side of the hotplate body with the casing being mounted on the hotplate body; and, ventilation gaps being provided between the upper side of the casing and the bottom side of the hotplate body for venting the snap-action switch and the bimetallic strip.

2. An electric hotplate, comprising:

a hotplate body including a central zone without direct heating means applied thereto, and a heated outer zone provided with heating resistors;

electric circuitry for connecting the heating resistors to a source of electrical energy including a thermostat positioned on a bottom side of the hotplate body and having a casing made from an insulating material;

the casing of the thermostat having a recess with a snap-action switch therein and a bimetallic strip acting on the switch disposed in the recess, the casing of the thermostat being provided with an outer recess between the electric connections of the snap-action switch, the recess being adapted for receiving a central downwardly projecting lug of the hotplate body;

an upper side of the casing being spaced at a distance from the bottom side of the hotplate body with the casing being mounted on the hotplate body, and the recess of the casing being open only on the upper side of the casing;

at least one projection projecting upwards at the upper side of the casing in the vicinity of the recess, the projection abutting against the bottom side of the hotplate body with the casing being mounted on the hotplate body; and, ventilation gaps being provided between the upper side of the casing and the bottom side of the hotplate body for venting the snap-action switch and the bimetallic strip.

3. An electric hotplate, comprising:

a hotplate body including a central zone without direct heating means applied thereto, and a heated outer zone provided with heating resistors;

electric circuitry for connecting the heating resistors to a source of electrical energy including a thermostat positioned on a bottom side of the hotplate body and having a casing made from an insulating material;

the casing of the thermostat having a recess with a snap-action switch and a bimetallic strip acting on the switch disposed in the recess;

an upper side of the casing being spaced at a distance from the bottom side of the hotplate body with the casing being mounted on the hotplate body, and the recess of the casing being open and uncovered on one whole side of the casing;

at least one projection projecting upwards at the upper side of the casing in the vicinity of the recess, the projection abutting against the bottom side of the hotplate body with the casing being mounted on the hotplate body;

ventilation gaps being provided between the upper side of the casing and the bottom side of the hotplate body for venting the snap-action switch and the bimetallic strip.

4. An electric hotplate according to claim 3, wherein the casing has walls surrounding the recess, edges of the walls surrounding the recess of the casing project over the snap-action switch approximately between 1 and 3 mm.

5. An electric hotplate according to claim 3, wherein the casing has walls surrounding the recess, edges of the walls surrounding the recess projecting over the bimetallic strip approximately between 1 and 33 mm.

6. An electric hotplate according to claim 3, wherein two projections are located on one side of the recess on the upper side of the casing.

7. An electric hotplate according to claim 3, wherein one projection is located on one side of the recess on the upper side of the casing.

8. An electric hotplate according to claim 3, wherein three projections are located on opposite sides of the recess on the upper side of the casing.

9. An electric hotplate according to claim 3, wherein the projection has a rounded configuration.

10. An electric hotplate body according to claim 3, wherein the projection has a conical configuration.

11. An electric hotplate according to claim 3, wherein the projection forms a one-part component with the casing, said casing being formed in one piece.

12. An electric hotplate according to claim 3, wherein a snap-action contact of the switch and the bimetallic strip are mounted on a support inserted from the open upper side of the casing into slots of the recess, an end portion of said support projecting through one of said slots and forming a connecting lug and securing said support in said casing.

13. An electric hotplate according to claim 3, wherein a counter contact of said snap-action switch is inserted into a slot of said casing.

14. An electric hotplate according to claim 3, wherein two electrical connections of said snap-action switch project near narrow end walls of the casing.

15. An electric hotplate, comprising:

a hotplate body including a central zone without direct heating means applied thereto, and a heated outer zone provided with heating resistors;

electric circuitry for connecting the heating resistors to a source of electrical energy including a thermostat positioned on a bottom side of the hotplate body and having a casing made from an insulating material;

a cover at least partly covering the bottom side of the hotplate body;

the casing of the thermostat having a recess with a switch and a bimetallic element acting on the switch disposed in the recess;

the casing of the thermostat being pressed against the bottom side of the hotplate body by spring means; and, the spring means being formed by an upwardly directed projection of said cover, lying against a flat bottom side of the casing and pressing the casing into contact and firmly against the bottom side of the hotplate body.

16. An electric hotplate according to claim 15, wherein the casing is pressed in the vicinity of a flattened portion of the hotplate body.

17. An electric hotplate according to claim 15, wherein the thermostat is positioned in the central zone of the hotplate body.

18. An electric hotplate according to claim 15, wherein the cover is pressed against the bottom side of the hotplate body and against the casing of the thermostat by means of a nut engaging a threaded bolt of the hotplate body.

19. An electric hotplate according to claim 15 wherein the cover comprises a cover plate provided in the vicinity of the thermostat and at least partly covering the bottom side of the hotplate body, the cover plate having openings.

20. An electric hotplate according to claim 15, wherein the cover comprises a cover plate and a covering part, the cover plate covering the bottom side of the hotplate body, the cover plate leaving the central zone uncovered, the covering part being a separate, perforated covering part fixed at the central zone by a central bolt engaging in the central zone of the hotplate body, said bolt projecting through a central portion of the covering part, the covering part being made from perforated sheet metal material and shaped like a cup.

21. An electric hotplate according to claim 20, wherein the cup-shaped covering part is made from a sheet metal material of substantial thickness, perforated prior to cup-shaping.

22. An electric hotplate according to claim 20, wherein the covering part has a thickness of more than 0.8 mm.

23. An electric hotplate according to claim 20, wherein perforations of the covering part are of a diameter of about a few millimeters.

24. An electric hotplate according to claim 20, wherein a surface covered by the perforations represents between one third and two thirds of a total surface area of the covering part.

25. An electric hotplate according to claim 24, wherein the surface covered by the perforation represents substantially half of the total surface area of the covering part.

26. An electric hotplate according to claim 20, wherein the cover part has a substantially cylindrical wall portion, the perforations also being provided in the substantially cylindrical wall portion of the covering part.

27. An electric hotplate according to claim 20, wherein substantially over its entire circumference, an edge of the covering part rests on a shoulder of the cover plate, the cover plate being annular, and the covering part pressing the cover plate against a rim of the hotplate body, said rim surrounding the central zone.

28. An electric hotplate according to claim 27, wherein the edge of the covering part has an all-round, outwardly projecting support flange.

* * * * *